United States Patent [19]

Elsner et al.

[11] Patent Number: 4,807,825

[45] Date of Patent: Feb. 28, 1989

[54] ROLL WINDING MACHINE

[75] Inventors: Bertram F. Elsner; Robert E. Molison, both of Hanover, Pa.

[73] Assignee: Elsner Engineering Works, Inc., Hanover, Pa.

[21] Appl. No.: 174,719

[22] Filed: Mar. 29, 1988

[51] Int. Cl.[4] ..... B65H 18/22

[52] U.S. Cl. ..... 242/56 R; 242/66; 242/DIG. 3

[58] Field of Search ..... 242/56 R, 66, 65, DIG. 3

[56] References Cited

U.S. PATENT DOCUMENTS

| | | | |
|---|---|---|---|
| 500,115 | 6/1893 | Crowell . | |
| 2,939,645 | 6/1960 | Rowlands et al. | 242/56 |
| 2,961,182 | 11/1960 | Beerli | 242/66 |
| 3,013,367 | 12/1961 | La Sarre | 53/3 |
| 3,077,316 | 2/1963 | Wells et al. | 242/65 |
| 4,002,308 | 1/1977 | Feighery | 242/66 |

FOREIGN PATENT DOCUMENTS

| | | |
|---|---|---|
| 1042640 | 11/1953 | France . |
| 715469 | 9/1954 | United Kingdom . |

*Primary Examiner*—Stuart S. Levy
*Assistant Examiner*—Steven M. duBois
*Attorney, Agent, or Firm*—Thomas Hooker

[57] ABSTRACT

A machine and method for winding coreless rolls from an indefinite length web by winding a spiral body in a winding pocket with a trailing end extending upstream from the pocket, releasing the body from the pocket and accelerating the body and trailing end downstream away from the pocket while winding the trailing end onto the body to complete the roll and to create a gap between the trailing end and the leading end of a web fed toward the pocket. Fingers are extended through the gap to guide the leading end of the web and into the pocket and intricate winding of the next roll.

23 Claims, 7 Drawing Sheets

FIG. 3
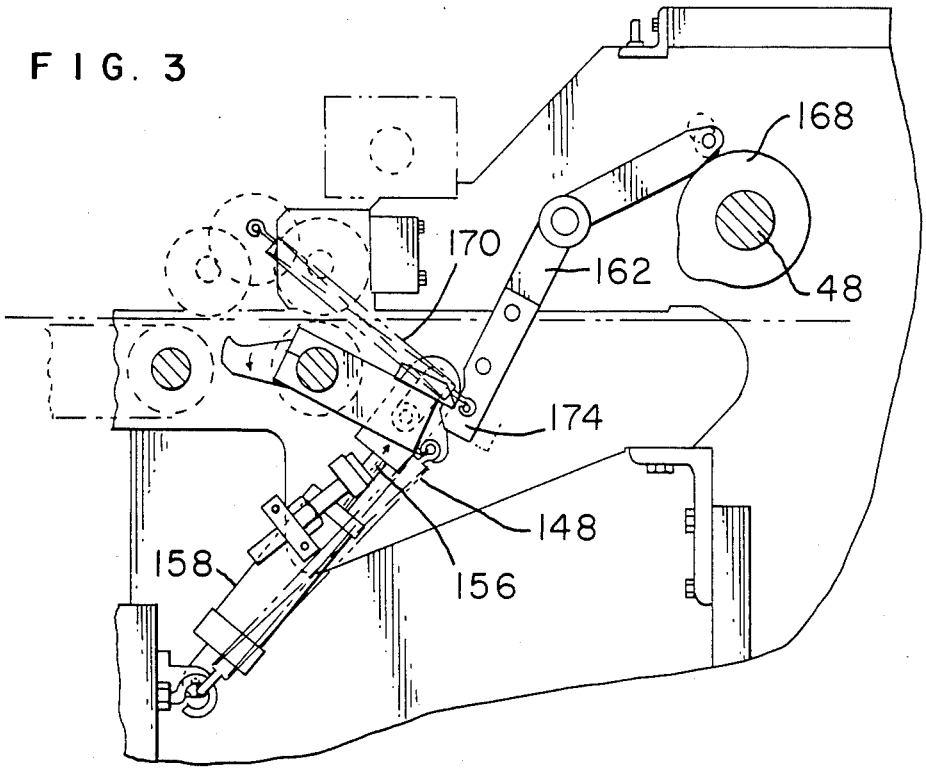
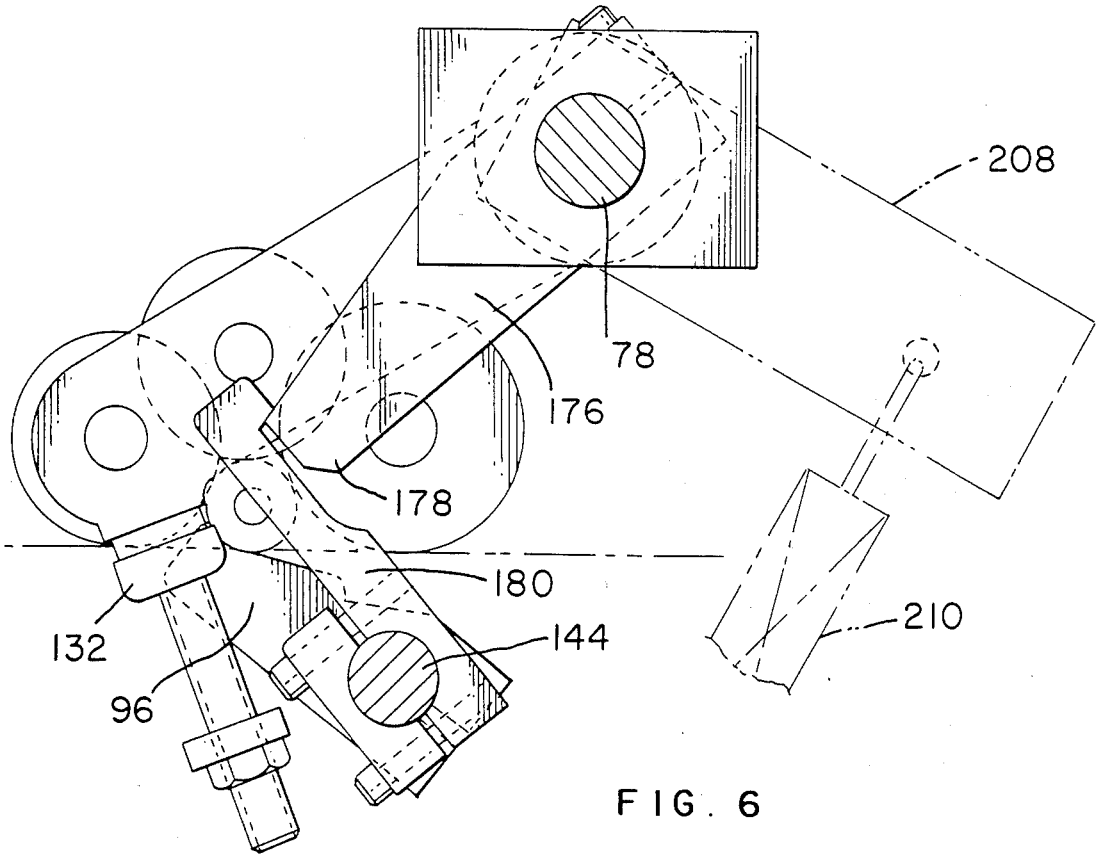
FIG. 6

ROLL WINDING MACHINE

The invention relates to a machine and method for high speed winding of individual coreless spiral rolls from a web continuously fed to the machine.

Conventional roll winding machines wind coreless rolls by feeding a web along a path to engage a deflecting finger extending across a path so that the web is deflected into and sprially wound within a winding pocket. The pocket then opens to discharge the completely wound roll. The web is fed to the pocket intermittently to establish a gap between leading and trailing ends of the web through which the deflecting finger is extended to guide the leading end into the winding pocket. The intermittent feed and complete winding of the web segment in the pocket slow production rates.

In the present invention coreless rolls are rapidly wound by continuously feeding a web through the machine to a winding pocket. A severed length of the web is partially wound into a spiral body in the pocket with a portion of the web extending upstream from the pocket. This partially formed roll is then discharged from the pocket and is accelerated downstream away from the pocket to form a gap between the accelerated trailing end of the partially wound roll and the leading end of the web being fed toward the pocket. Deflecting fingers are extended through the gap to guide the leading end of the web into the pocket without the necessity of slowing the rate at which the web is fed through the machine. The partially wound spiral body is accelerated and rotated downstream to wind the trailing end into the body and complete the roll.

In this way, coreless rolls are wound in a rapid two-step operation with the majority of the roll spiral wound in the pocket and a short trailing portion wound outside of the pocket at an accelerated rate to form the gap and complete the roll.

The machine winds coreless rolls at a rate approximately 100 percent more rapidly than coreless rolls wound by conventional winding machines. While the machine may be used to wind rolls from various types of web material, it is particularly useful in winding paper and plastic rolls from an indefinite length web.

Other objects and features of the invention will become apparent as the description proceeds, especially when taken in conjunction with the accompanying drawings illustrating the invention, of which there are 7 sheets and one embodiment.

IN THE DRAWINGS

FIG. 1 is a generalized vertical sectional view extending along the feed path of the roll winding machine;

FIGS. 2*a* and 2*b* are broken away top views of the machine taken looking generally along line 2—2 of FIG. 1 and joined line A;

FIGS. 3 and 4 are sectional views taken generally along line 3—3 of FIG. 2*a* showing the machine in different positions;

FIG. 6 is an enlarged vertical sectional view similar to FIG. 5;

Figure 2A:
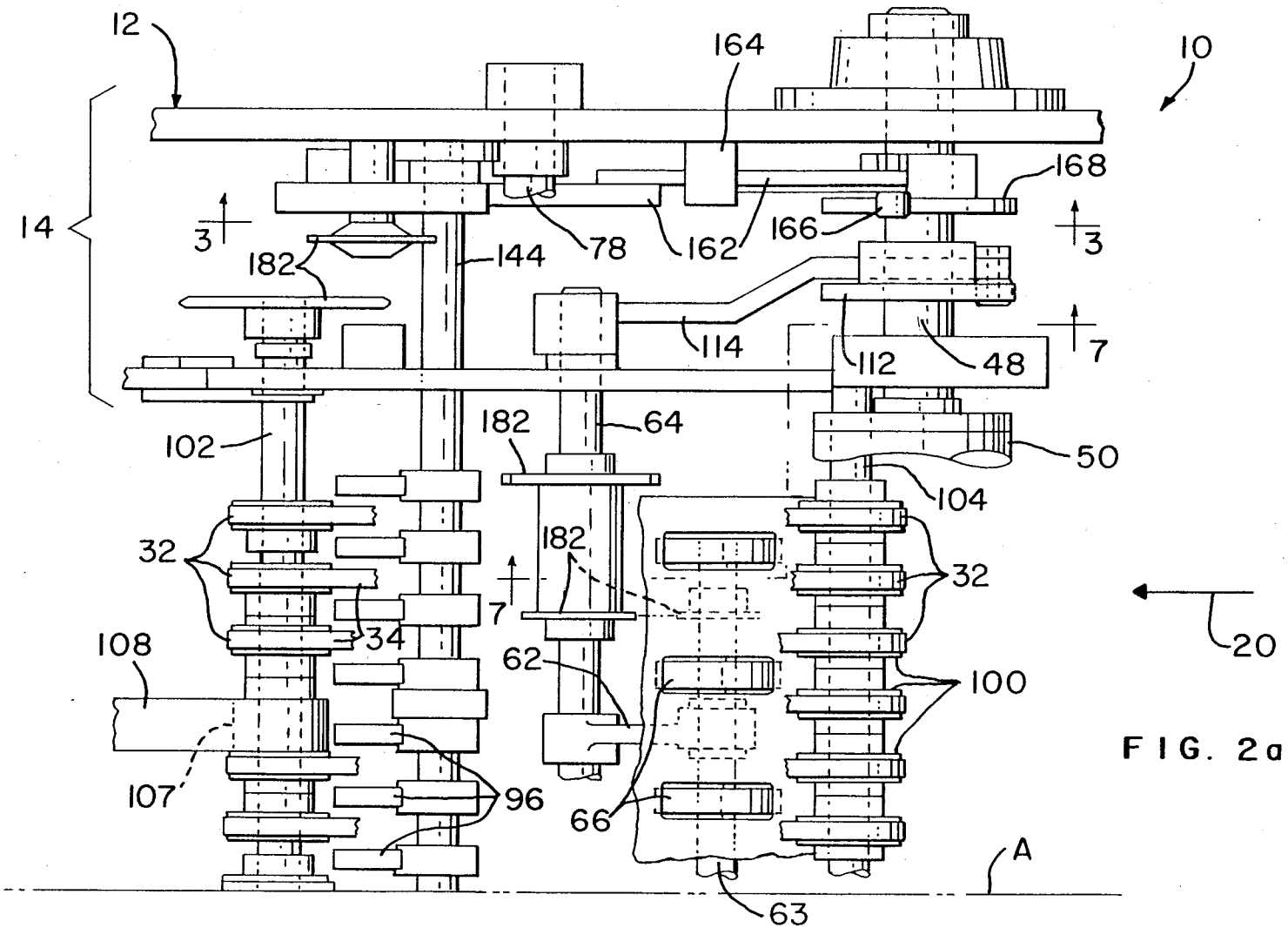
Figure 2B:
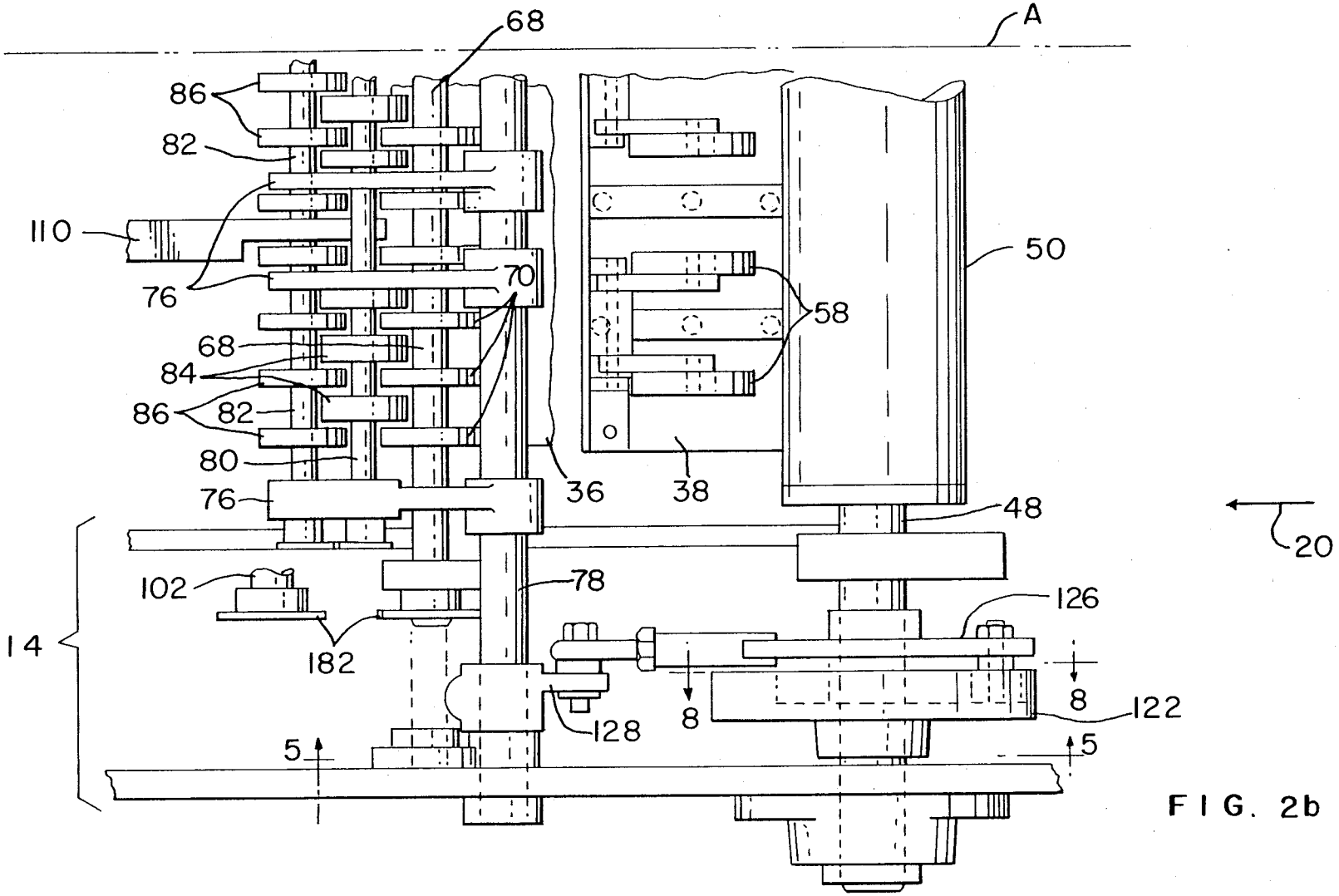
Figure 7:
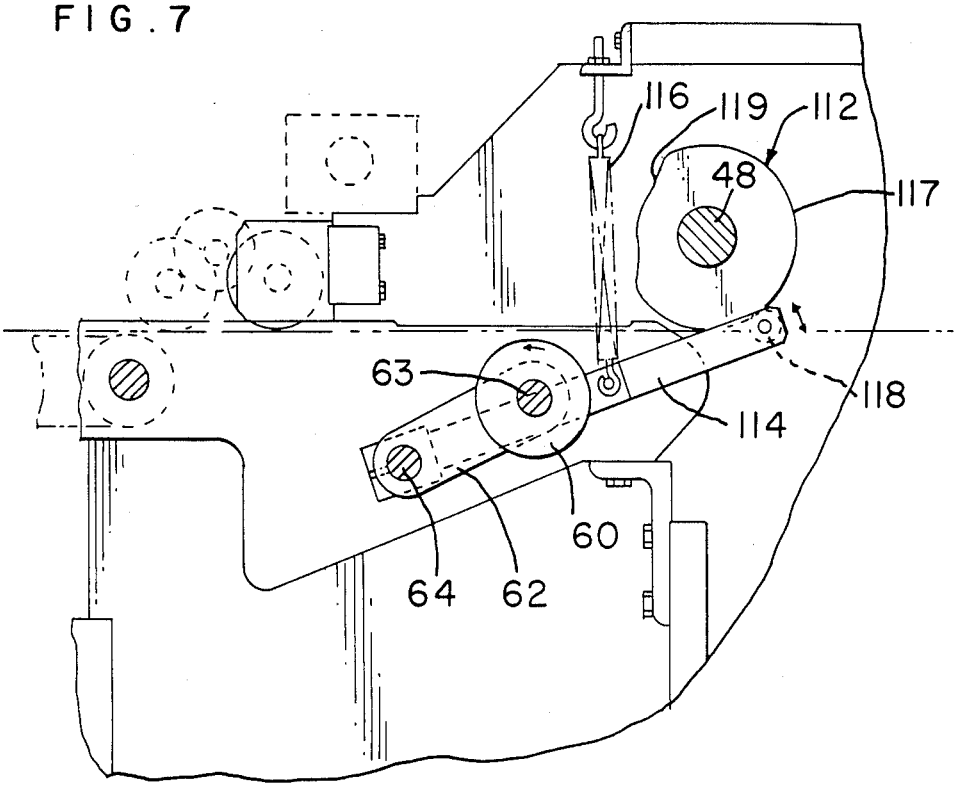
Figure 8:
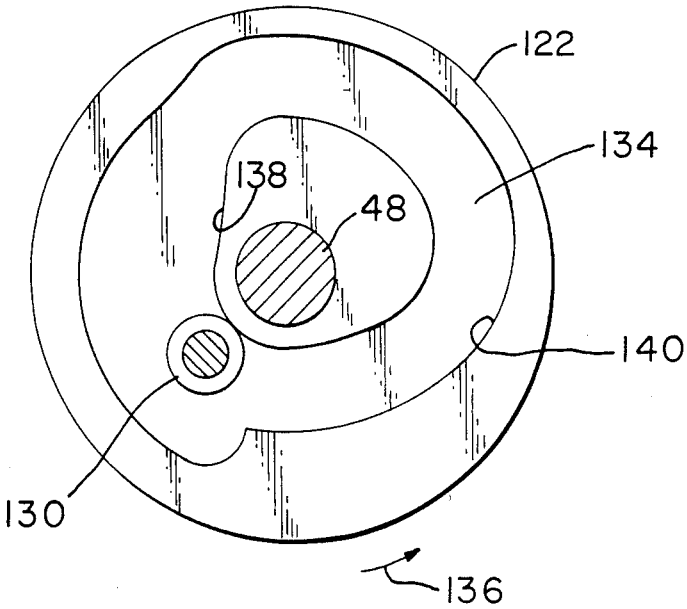

FIGS. 7 and 8 are vertical sectional views taken respectively along line 7—7 of FIG. 2*a* and 8—8 of FIG. 2*b*; and FIGS. 9, 10, 11 and 12 are generalized vertical sectional views illustrating the operation of the machine.

Roll wrapping machine 10 includes a frame 12 with a pair of spaced parallel side walls 14. A continuous paper web 16 extends from a source roll (not illustrated) and moves in the direction of arrow 20 around guide rolls 18 extending between the side walls, through web feed assembly 22 and thence downstream along a straight path 24 between the frame side walls. Web cutting assembly 26, web separation assembly 28 and rolling assembly 30 are spaced along path 24 downstream from the feed assembly 22. As shown in FIG. 2, a plurality of narrow feed belts 32 are spaced across the width of path 24 and include upper straight runs 34 extending along the path beneath the separation and rolling assemblies. A drive rotates runs 34 downstream at the speed the web moves along the path. Hold-down plates 36 and 38 extend across the path 24 above the belt runs 34 and loosely confine ball weights 40 which hold the web against the upper belt runs 34.

The web feed assembly 22 includes a pair of feed rolls 42 extending transversely across path 24 and mounted on shafts 44 carried in bearings on the side walls 14. During operation of machine 10, the rolls 42 are continuously driven to move the web 16 down the path 24 at a continuous high speed. Web guides 46 are located on either side of the path 24 downstream of the rolls 42 and guide the web discharge from the rolls. As illustrated, the upstream ends of the guides extend into circumferential grooves in the rolls, thereby assuring positive capture of the web.

Web cutting assembly 26 includes a shaft 48 extending between side walls 14 and journalled in bearings carried on the side walls. The shaft carries a roller 50 which in turn supports a rotary knife 52 which extends across the web. A one revolution clutch (not illustrated) connects the shaft 48 to the continuously operating drive motor of machine 10 such that engagement of the clutch rotates the shaft and the knife 52 through a 360 degree rotation in the direction of arrow 54 starting and stopping at the position of FIG. 1. Rotation of the roll sweeps the cutting edge of knife 52 past the cutting edge of a fixed serrated bed knife 56 extending across the path below the web to form a serrated cut line extending across the web without severing the web.

The web separation assembly 28 includes a plurality of freely rotating rolls 58 mounted on plate 38 and extending through recesses formed in the plate to rest on the upper surface of the web. A plurality of web separating wheels 60 are mounted on a shaft 63 carried by arms 62 which are in turn mounted on shaft 64 extending between the side walls. Each wheel 60 is located beneath a roll 58 and is laterally spaced between a pair of adjacent belts 32. A drive continuously rotates separating wheels 60 in the direction of arrow 66 at a circumferential speed greater than the speed at which the web is moved downstream by belts 32.

The web is severed in a two-step operation. First, the knives 52 and 56 form the serrated cut, as described. This cut is then moved downstream to a position immediately upstream of the separation assembly. At this juncture, shaft 64 is rotated to raise the overspeed wheels 66 into contact with the web and hold the web against rolls 58 thereby pulling the confined web downstream at an accelerated speed and breaking the web at the serrations. The new leading and trailing web ends are confined between plate 38 and the upper runs 34 of belt 32 when the web is broken to assure continuous and high speed feeding of the severed web without causing jams. Residual curls or tension in the web could result in misfeeding and jams in the event the unconfined web was completely severed at the cutting assembly 26. The separating wheels 60 are lowered following separation of the web at the serrated cut line.

Rolling assembly 30 includes a shaft 68 extending between bearings in side walls 14 and carrying a number of spaced rolls 70 each of which extends into a space between fingers in plate 36. Shaft 68 and rolls 70 are continuously rotated in the direction of arrow 72 at a circumferential speed equal to the speed at which the belts 32 and the web are moved downstream. Rolls 70 are above path 24 and do not contact the web moving along the path.

The rolling assembly 30 also includes an adjustable rolling head 74 having a pair of arms 76 each located on one side of the path 34 and mounted on a cross shaft 78 which is in turn journalled into bearings on the side walls 14. Arms 76 carry a pair of rotating shafts 80 and 82 extending across path 24. The shaft 80 carries a plurality of spaced rolls 84 which extend into recesses between the spaced rolls 70 on shaft 68. Shaft 82 carries the plurality of spaced rolls 86 which extend into the recesses between rolls 84 on shaft 80. The shafts 80, 82 and rolls 84 and 86 are continuously rotated in the directions of arrows 88 and 90 during operation of machine 10. These rolls are rotated at a circumferential speed equal to the downstream speed of belts 32 and the web.

Figure 1:
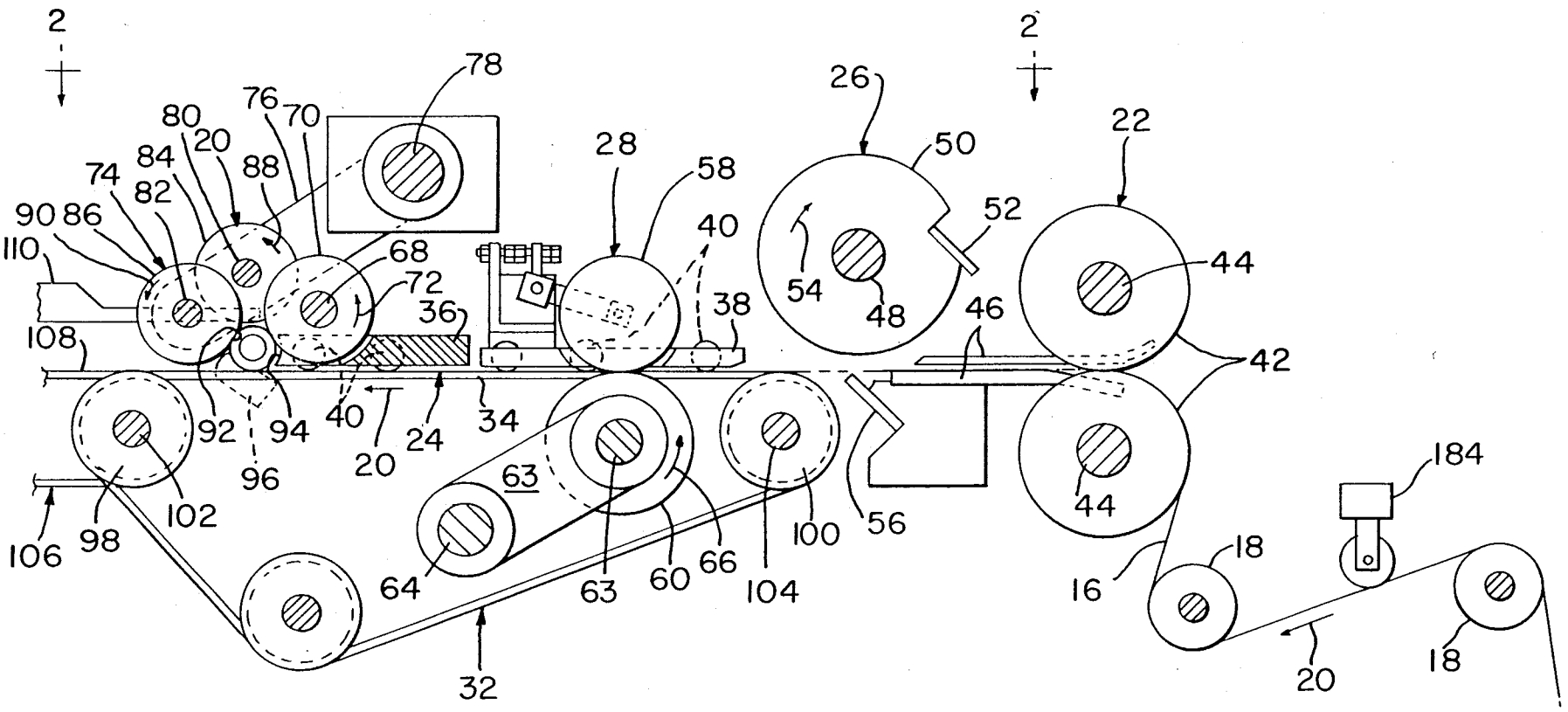

As shown in FIG. 1, the upper run 34 of belts 32 and rolls 70, 84 and 86 define a web winding pocket 92 extending laterally across the path 24 above the belts. The downstream edge 94 of plate 36 defines the upstream side of the pocket immediately above the belts 32. A plurality of guide fingers 96 normally located beneath the upper runs of belts 32 are extended into the downstream side of the pocket to guide the leading end of the web into the pocket during initial winding.

Belts 32 are wrapped around pulleys 98 and 100 on shafts 102 and 104 adjacent the upstream and downstream ends of runs 34. A pair of discharge belts 106 extend around rollers 107 rotatably mounted on shaft 102 and include upper downstream runs 108. The belts 106 are driven so that the runs 108 move downstream in the direction of arrow 20 approximately one and one-half times faster than the downstream speed of the upper runs of belts 32. A pair of take-away rails 110 are mounted on frame 12 above the belt runs 108 and extend into the winding pocket 92. The rails 110 are spaced above the upper belt runs 34 and 108 a distance slightly less than the diameter of a spiral body fully wound in the pocket 92.

The web separation assembly 28 shown in FIG. 7 and includes a rotary cam 112 mounted on shaft 48 and a control arm 114 secured to shaft 64 and extending beneath cam 112. A spring 116 biases the arm toward the cam so that roller 118 on the end of the arm is held against the cam.

When shaft 48 is at the dwell or rest position as shown in FIG. 7, roller 118 engages the circumferential dwell surface 117 of cam 112 and separating wheels 60 are located below the upper runs 34 of belts 32 as shown. Following engagement of the one revolution clutch and rotation of shaft 48 the cam 112 is rotated and roller 118 falls into cam recess 119 thereby rotating shaft 64 to raise the separating wheels 60 for engagement with the web immediately downstream of the serrated cut formed in the web by the knives 52 and 56 to pull the downstream portion of the web away from the upstream portion and separate the web while the ends are confined between the belts 32 and hold-down plate 38. Continued rotation of shaft 48 rapidly returns roller 118 to the dwell surface to lower the separation wheels below the belts 32 and permit continued uninterrupted downstream movement of the web.

The rolling head 74 rotates on shaft 78 and is allowed to rotate upwardly a slight distance in the direction of arrow 120 during winding of the web in pocket 92. The upward rotation of the rolling head is in response to the increasing diameter of the partially formed roll.

Figure 5:
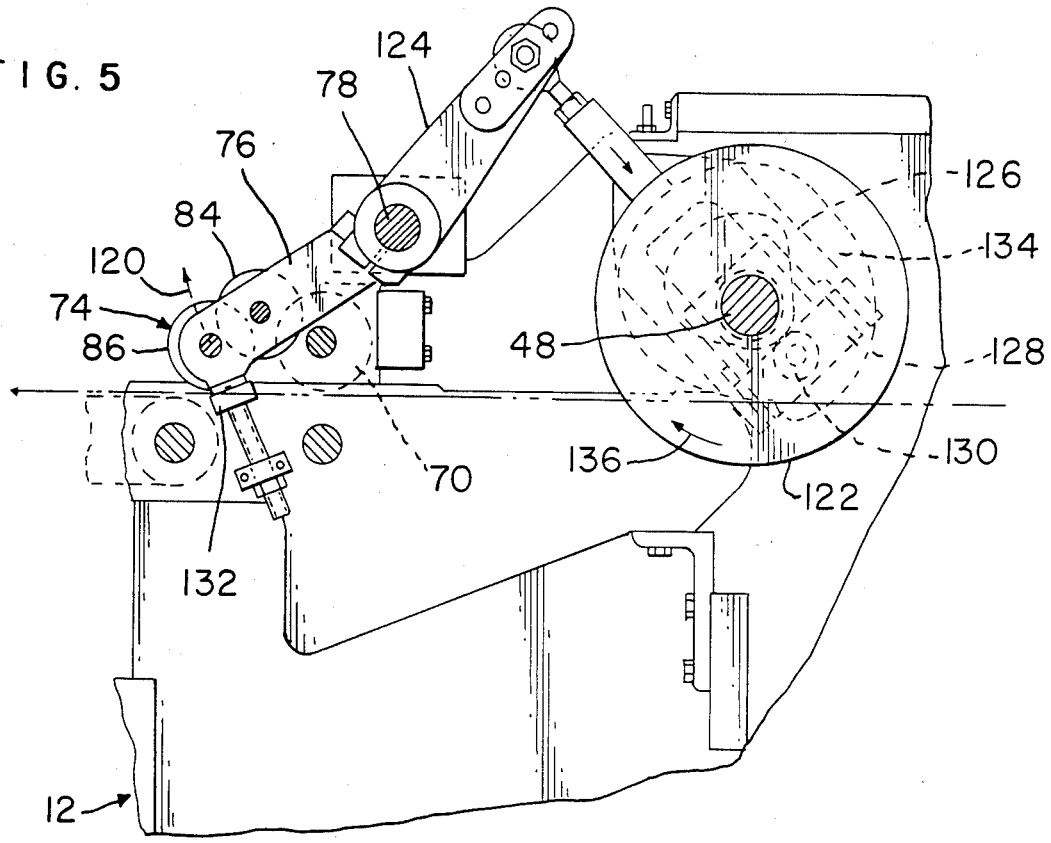
FIG. 5 is a vertical sectional view taken generally along line 5—5 of FIG. 2*b;*

Following winding of the partially wound roll in pocket 92, the rolling head is positively rotated upwardly in direction of arrow 120 by rotary cam 122 mounted on shaft 48. The head is connected to the cam by arm 124 mounted on shaft 78 and a yoke 126 extending from the free end of arm 124, around shaft 48 to an end 128 carrying a roller 130. The roller is fitted within a cam recess 134 formed in the face of cam 122. With shaft 48 in the dwell position and rolling head 74 closed arms 76 engage fixed stops 132 on the sidewalls and the roller 130 rests on the inner circumference of the cam recess 134. See FIG. 5. At this position, the cam recess has a radial length greater than the diameter of the roller so that the head 74 may rotate upwardly in the direction of arrow 120 in response to increase in the diameter of the roll being wound in pocket 92.

Upon engagement of the one revolution clutch and rotation of shaft 48, cam 122 is rotated 360 degrees in the direction of arrow 136 thereby bringing the inner rise surface 138 into contact with roller 130 to rapidly rotate head 74 up in the direction of arrow 120 to open the pocket and allow discharge of the spiral wound body downstream between the take away rails 110 and belts 32 and 106. Continued rotation of the shaft brings the roller into contact with fall surface 140 of the cam which returns the roller to the start position and closes the rolling head against stops 132 to thereby re-establish the winding pocket 92 for winding of the next successive length of web.

Figure 4:
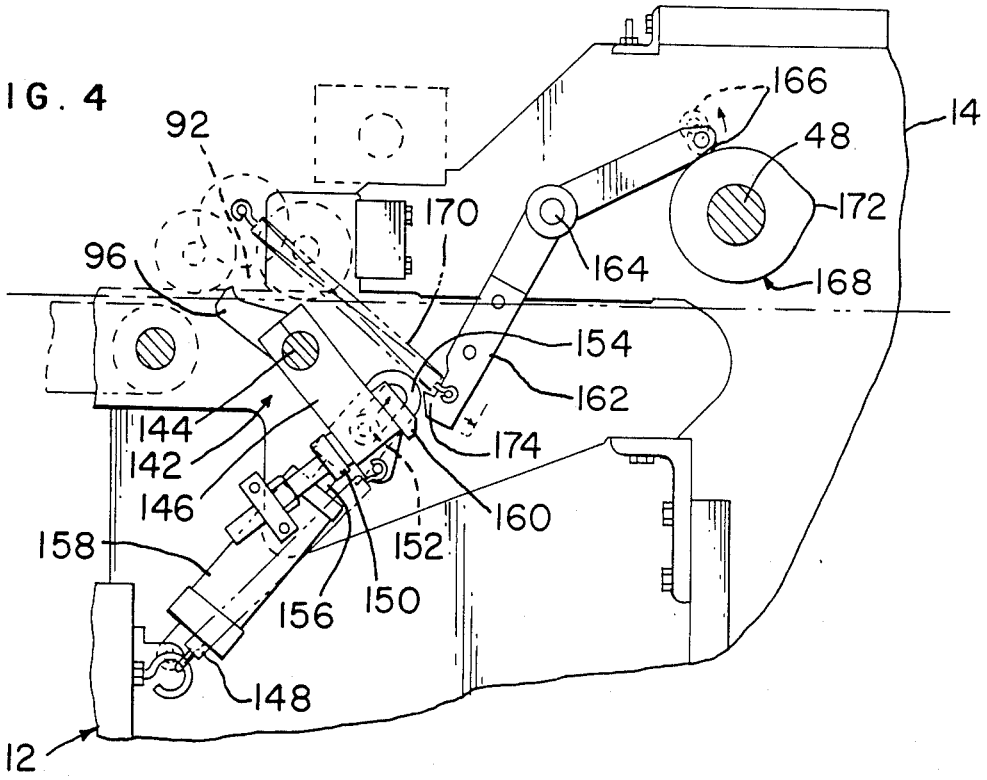

Guide finger assembly 142 is located below the path 24 at the rolling assembly 30. Guide fingers 96 are mounted on a finger pivot shaft 144 extending between bearings o the opposed sidewalls and carrying a downwardly extending lever arm 146. Spring 148 is connected between the end of the arm 146 and a support on frame 12 and biases the arm 146 toward fixed stop 150. With the arm against the stop the shaft 144 is rotated and the fingers 96 extend above the upper runs 34 of belts 32 and into the downstream side of the winding pocket 92 as shown in FIGS. 1 and 4.

The free end of arm 146 carries a roller 152 which extends into a slotted head 154 mounted on the end of piston rod 156 of cylinder 158. A beveled keeper 160 is also mounted on the end of arm 146 adjacent the latch end of release lever arm 162. This arm is rotatably mounted on a sidewall at bearing 164 and includes a cam roller 166 mounted on the remote end adjacent cam 168 on shaft 48. Spring 170 extends between arm 162 and a support on frame 12 to bias roller 166 against the cam 168.

Upon actuation of the one revolution clutch and rotation of shaft 48 through a single 360 degree cycle, the lobe 172 of cam 168 rotates arm 162 to move latch 174 on the free end of the arm out from under the keeper 160 thereby allowing spring 148 to rotate the arm 146 and shaft 144 and thereby raise the fingers 96 to the winding pocket to guide the lead end of the next length of web material into the pocket. When the cam falls off the lobe 172, cylinder 158 is extended to counter-rotate shaft 144, retract the fingers below the upper runs of belts 32 and move the keeper 160 behind the returned latch 174. Following latching of the fingers in the retracted position, the cylinder 158 is reversed to withdraw the slotted head from the extended position so that spring 148 may re-extend the fingers into the winding pocket upon the next revolution of the shaft 48.

The guide finger assembly includes a rolling head latch assembly 17 shown in FIG. 6 for holding the rolling head in the full down position against stops 132. This assembly includes a latch lever 176 mounted on cross shaft 78 having a free end 178. A rolling head latch hook 180 is mounted on finger pivot shaft 144 such that when the shaft and fingers are rotated to raise the fingers to the winding pocket 92 the latch hook 180 extends over the free end 178 of lever 176, thereby holding the rolling head 74 in the down position and in abutment with stops 132. The latch hook disengages from the lever 176 simultaneously with retraction of the fingers below the belts 32. Lever 176 and hook 180 are located adjacent a sidewall 14, away from the web moving through the machine.

The continuously rotated rolls or wheels 42, 60, 70, 84, 86, 98 and 100 and 107 are driven at appropriate rotational speeds by a drive motor (not illustrated) through a suitable drive mechanism (not illustrated). This mechanism includes a number of sprocket gears 182, some of which are shown in the drawings.

The operation of machine 10 will now be described with reference to FIGS. 9 through 12. The machine rapidly and repetitively winds coreless rolls formed from lengths of web 16 continuously fed down path 24. The rolls are partially wound in pocket 92 and are then discharged from the pocket and accelerated downstream to complete winding and at the same time form a gap between the trailing end of the web being wound into the roll and the loading end of the downstream moving web. The gap is formed without slowing the rate at which the web is moved through the machine yet permits free movement of the fingers across the path to guide the lead end of the web into the winding pocket.

Figure 9:
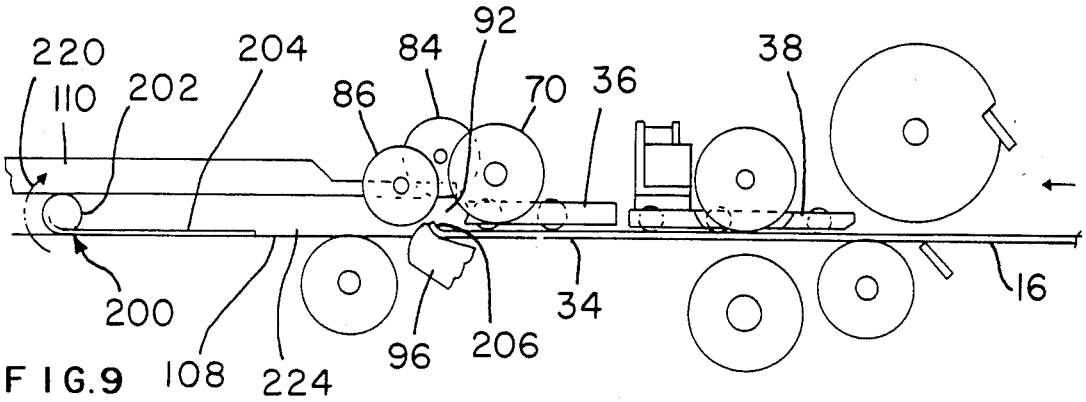
Figure 10:
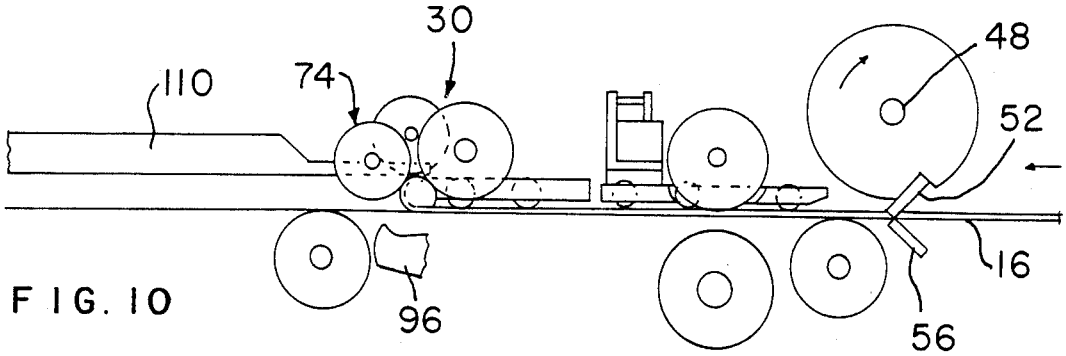

FIG. 9 illustrates the position of the machine following opening of the roller head 74, downstream discharge of a nearly completely wound product roll 200 having a cylindrical spiral wound body 202 with the trailing end 204 of the web segment extending upstream from the body along the upper runs 108 of discharge belts 106. Guide fingers 96 extend up above path 24 between the upper straight runs 34 of feed belts 32. In this position, the lead end 206 of the web 16 has been moved downstream by belts 32, engaged the raised fingers 96 and is directed up into the winding pocket 92. The rolling head 74 is latched closed with rolls 70, 84 and 86 rotating in the directions of arrows 72, 88 and 90 so that with continued downstream movement of the web the end 206 is moved around the outer circumference of the winding pocket 92 by the rolls and along the concave surfaces 94 on the downstream end of plate 36 to guide the lead end 206 of the web around the pocket and back into contact with the web to form a spiral wound body 202 within the pocket.

During initial feeding of the end 206 into the pocket the rolling head latch hook 180 engages latch lever 176 as shown in FIG. 6 to hold the rolling head in the closed position against stops 132 and thereby prevents the rapidly moving leading web end 206 from striking the rolls 84 and 88 and pivoting the rolling head above the closed position.

After the initial length of the web has been spiral wound in the pocket to initiate winding of the body 202, cylinder 158 is extended to move the keeper 160 behind the latch 174 on the end of arm 162 and thereby rotate finger pivot shaft 144 to retract the guide fingers 96 beneath the feed path and unlatch the rolling head 74. Continued downstream movement of the web feeds additional web material into the pocket 92 and winds the material into the body 202.

The additional web material wound into the body 202 increases the diameter of the body and correspondingly lifts the freed rolling head to increase the size of the pocket to accommodate the growing body. Lifting of the head moves roller 130 radially outwardly away from the inner surface of cam 122. See FIG. 8. In some applications it may be desirable to bias the rolling head toward or away from the closed position, depending upon the properties of the particular winding operation. For instance, if desired, a lever arm 208 may be mounted on cross shaft 78 so that spring 210 lightly biases head 74 toward the open positions. In some situations it may be desirable to extend arm 208 to the opposite side of shaft 78 and thereby bias the rolling head toward the closed position.

Web length counter 184 shown in FIG. 1 measures the length of the web fed into the body 202 in the winding pocket. When the desired length of the web has moved past the counter, the counter 184 actuates the one revolution clutch connecting the drive motor to shaft 48 to thereby rapidly rotating the shaft and cutting blade 52 through 360 degrees so that the blade moves past a fixed blade 56 and forms a serrated cut extending across the web. See FIG. 10.

Figure 11:
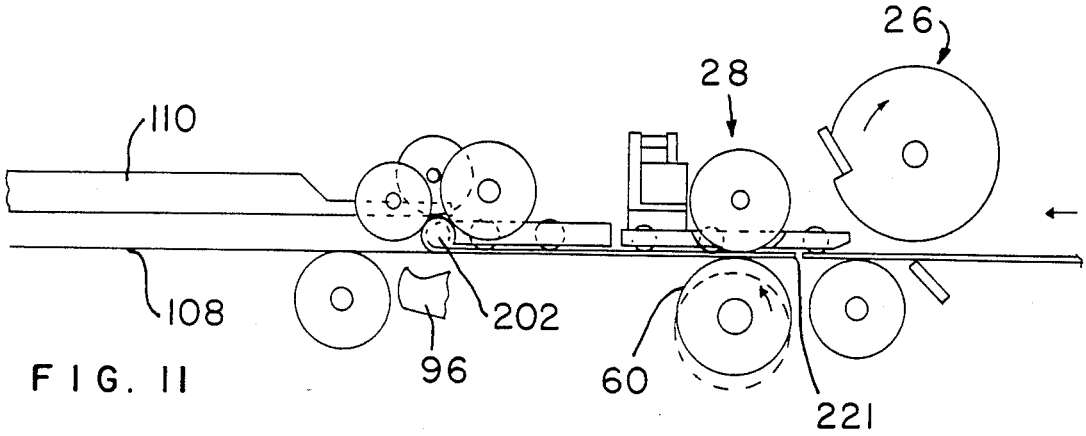

The web continues to move downstream as shown in FIG. 11 until the serrated cut is located immediately upstream of the web separating assembly 28. At this time rotation of the shaft 48 rotates cam 112 to move roller 118 from the dwell surface 117 into recess 119 thereby allowing spring 116 to raise overspeed separating wheels 60 to capture the web between wheels 60 and rolls 58, accelerate the web downstream sufficiently and break the serrated cut at 221. Continued rotation of cam 112 lowers wheels 60 below the web.

Figure 12:
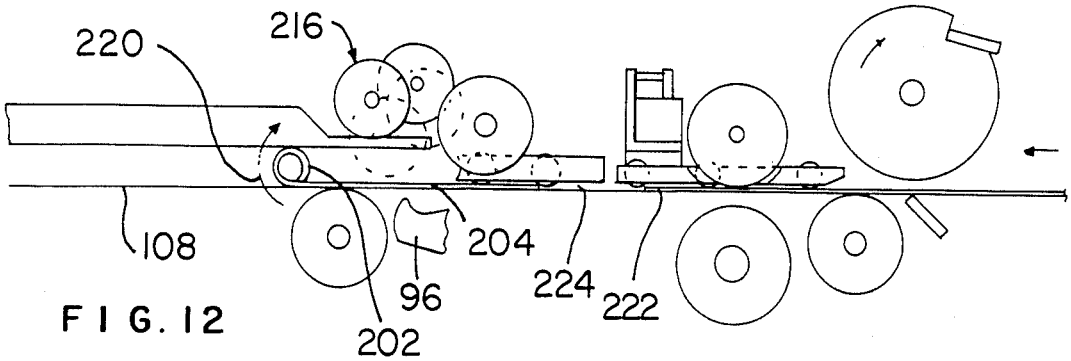

Immediately following separation of the web by assembly 28 the spiral body 202 growing in pocket 92 increases in diameter sufficiently to engage the lower surfaces of the take away rails 110 above the pocket. When this happens the continued rotation of shaft 48 rotates the rise surface 138 of cam 122 against roller 130 to rapidly raise the rolling head 74 to a discharge position 216 with rolls 84 and 86 located above the rails 110 as shown in FIG. 12. Upward movement of the rolling head opens the downstream side of the winding pocket and allows the downstream moving belts 32 to rotate the spiral body downstream against the lower surfaces of the hold down rails 110. The body rotates in the direction of arrow 220 shown in FIGS. 9 and 12 as it moves downstream so that it winds the trailing end of the web 204 into the body. The belts 32 rotate the body downstream at one-half the speed the belts move downstream. The trailing end 204 moves downstream at the same speed as the belts 32 and the break 221 extending across the web remains closed.

Body 202 and trailing end 204 move downstream along belts 32 and onto the high speed downstream upper runs 108 of belts 106. The accelerated downstream rotation of the body 202 by runs 108 moves the body and trailing web 204 downstream at an accelerated rate, faster than the downstream moving leading web end 222 moving on belts 32 thereby creating a gap 224 between the leading and trailing web ends. Further downstream movement of the body 202 by belts 106 completely winds the trailing end 204 onto the body to complete the roll. The roll may then be banded or packaged as required.

Immediately after the body 202 has been discharged and moves downstream from the pocket 92 shaft 48 rotates cam 122 to close the rolling head as described and seat arms 76 against stops 132. When gap 224 is beneath pocket 92 shaft 48 rotates cam 168 so that lobe 172 engages roller 166 and pivots the release lever arm 162. Latch 174 is moved out of engagement with keeper 160 spring 148 rotates shaft 144 and re-extends guide fingers 96 through the gap and into the downstream side of the pocket. The fingers guide the new leading end 222 of the next length of web into the pocket 92 as previously described. Rotation of shaft 144 also locks the rolling head in the closed position as previously described and illustrated in FIG. 6. The clutch disengages upon completion of the 360 degree revolution of shaft 48 to return of the machine to the position of FIG. 9 and complete one cycle of operation.

Machine 10 automatically and rapidly winds relatively small coreless spiral rolls 200 from a continuous length of web material, commonly paper and plastic, supplied to the machine at a high speed constant rate. The machine winds these rolls at a high rate approximately 100 percent greater than the winding rate of conventional coreless roll winding machines.

During high speed coreless winding it is necessary to positively guide the leading end of the web into the winding pocket. Accelerated movement of a partially wound roll and associated trailing end away from the pocket creates a gap between the leading and trailing edges of the continuously fed web which permits rapid movement of the guide fingers 96 up above the conveyor belt and into the pocket so that the new leading end is positively guided into and around the winding pocket independently of curls or stresses commonly found in long length wound webs. The two step severing operation of the web where the web is first serrated and then the serration is broken while the web is confined also prevents jams for the same reason.

Depending upon the size of the web wound by machine 10 the winding head may include two or more sets of rolls, here 84 or 86, or, in the case of small diameter rolls being wound in pocket 92, the head may include a single set of rolls. In the latter case, the rolls on the winding head extend between the fixed rolls 70 to assure that the web material fed to the pocket is continuously conveyed around the circumference of the pocket during initial winding.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim as our invention is:

1. In a machine for winding coreless rolls from an indefinite length web the combination of:

(a) first feed means for moving a web downstream along a feed path at a first rate;

(b) a rolling assembly located on one side of the feed path and including web winding means defining a winding pocket for winding the lead end of a web moved down the path into a spiral body, and winding pocket opening means on the downstream side of the winding pocket for opening the winding pocket;

(c) a guide finger assembly located on the other side of the path across from the rolling assembly, the guide finger assembly including a guide finger movable across the path to the downstream edge of the winding pocket to deflect the lead end of a web moving down the path into the winding pocket and retractable back across the path;

(d) web cutting means located on the path upstream of the rolling assembly for severing the web to form a trailing web end and a leading web end;

(e) second feed means located on the path downstream from the rolling assembly for moving a spiral wound body and the trailing web end downstream along the path at a second rate greater than the first rate to form a gap between the trailing web end and the leading web end; and (f) finger drive means for moving the finger across the path at the gap to guide the lead end of the web into the winding pocket.

2. A machine as in claim 1 wherein said second feed means includes winding means for rotating the spiral body and winding the trailing web end onto the body to complete the roll.

3. A machine as in claim 2 wherein the rolling assembly includes a rolling head on the downstream side of the winding pocket, and a rolling head drive for moving the rolling head away from the pocket to allow downstream movement of the spiral body.

4. A machine as in claim 3 wherein the rolling assembly includes a plurality of rolls spaced around the winding pocket above the first feed means, and a drive operable to rotate said rolls at said first rate.

5. A machine as in claim 4 wherein one of said rolls is mounted on the rolling head.

6. A machine as in claim 4 wherein two of said rolls are mounted on the said rolling head.

7. A machine as in claim 4 including guide means on the upstream side of the winding pocket extending between the first feed means and an adjacent roll.

8. A machine as in claim 4 wherein said web cutting means includes serration means for forming a serrated cut extending laterally across the web without separating the web, separating means located between the rolling assembly and the serrating means for breaking the serrated cut and web end confining means at the serrating means for confining the trailing web end and leading web end on the path.

9. A machine as in claim 4 wherein said second feed means comprises a belt extending downstream along the path and a rail spaced above the belt a distance approximately equal to the diameter of the spiral body and extending into the winding pocket whereby the body is captured between the belt and rail and is rotated downstream from the rolling assembly and winds the trailing end of the web into the body.

10. A roll winding machine including first and second belts extending along adjacent portions of a feed path, first belt drive means for moving the first belt downstream along the path at a first rate; second belt drive means for moving the second belt downstream along the path at a second rate greater than the first rate; a rolling assembly on one side of the path defining a winding pocket extending across the first belt adjacent the second belt, the assembly including a plurality of rolls extending around the winding pocket, a rolling head supporting at least one roll located on the downstream side of the pocket, and opening means for moving the rolling head away from the path to open the downstream side of the winding pocket; web cutting means located on the path upstream of the rolling assembly for forming a cut through the web to define leading and trailing ends of the web; a take away rail located above the path and extending downstream from the winding pocket along the second belt; a guide finger assembly located on the other side of the path opposite the rolling assembly, the guide finger assembly including a guide finger movable through the path to the downstream side of the winding pocket and a finger drive for extending and retracting the finger across the path; and drive means for rotating said rolls at a circumferential speed equal to said first rate whereby upon continuous movement of a web downstream along said first belt the lead end of the web is spiral wound in the winding pocket to form a spiral body, said opening means opens the pocket for discharge of the winding of the spiral body and said second belt rotates such body downstream at the second rate to form a gap between the leading and trailing web ends for extension of the finger and to complete winding of the trailing end of the web onto the body to complete the roll.

11. A machine as in claim 10 wherein said web cutting means includes perforating means for forming perforations extending across the web, a web separator located downstream of the perforating means for breaking the perforations and web confining means retaining the leading and trailing web ends on the path.

12. A machine as in claim 10 wherein said web cutting means includes a shaft extending across one side of the path, a rotary cutting blade mounted on the shaft, a fixed blade mounted opposite the shaft on the other side of the path and cooperable with the rotary cutting blade upon rotation of the shaft to form a cut extending across the web; the finger drive including a cam mounted on said shaft, a latch mechanism extending between the cam and the finger, a device biasing the finger toward the extended position and a drive element to overcome said device and retract the finger across the path whereby upon rotation of said shaft said cam trips the latch mechanism to permit the device to extend the finger into the downstream side of the pocket and actuation of said drive element retracts the finger from the pocket and forms a latch connection holding the finger in the retracted position.

13. A machine as in claim 12 including a second cam on said shaft and a drive connection extending between said second cam and said rolling head whereby upon rotation of the shaft said second cam actuates the connection and moves the rolling head away from the pocket upon growth of the spiral body into contact with the take away rail.

14. A machine as in claim 13 wherein said second cam permits free movement of the rolling head outwardly of the pocket to accommodate increased size of the spiral body during winding.

15. A machine as in claim 14 wherein one of said knives includes a serrated edge so that said web cutting means forms a serrated cut across the web, and including a separation assembly located on the path between said web cutting means and said rolling assembly, said separating assembly including a separating device for engaging the web and applying a tensile force at the serrated cut sufficient to break the cut and form said leading and trailing web ends.

16. A machine as in claim 15 wherein said separating assembly includes a third cam on said shaft, a connection between such cam and the separating device to bring such device into contact with the web adjacent the serrated cut, and drive means for moving the device at a speed greater than said first rate.

17. The method of winding coreless rolls from an indefinite length web comprising the steps of:

(a) continuously moving a web downstream along a path toward a winding pocket at a first rate;
(b) winding the lead end of the web in the pocket to form a spiral body;
(c) cutting the web upstream of the pocket to form a trailing end of the web extending upstream from the body and a leading end of the web at the cut;
(d) moving the spiral body and the trailing end of the web along the path downstream from the pocket at a second rate greater than the first rate to open a gap in the web at the cut;
(e) positioning a guide finger across the path in the gap and into the downstream side of the winding pocket to deflect the leading end of the web into the pocket for winding; and
(f) winding the trailing end of the web onto the spiral body to form a roll.

18. The method of claim 17 including the step of rotating the spiral body away from the pocket and simultaneously winding the trailing end into the spiral body.

19. The method of claim 18 including the step of opening the pocket and rotating the spiral body out of the pocket.

20. The method of claim 19 including the steps of perforating the web, moving the perforations downstream, confining the perforations on the path and then breaking the perforations.

21. The method of claim 20 including the step of breaking the perforations by moving the trailing end downstream away from the leading end.

22. The method of claim 17 including the step of rotating the spiral body downstream from the winding pocket against a rail at a speed proportional to said first rate and then proportional to said second rate.

23. The method of claim 17 including expanding the rolling pocket as the diameter of the spiral body increases.

* * * * *